US006981838B2

(12) United States Patent
McKee et al.

(10) Patent No.: US 6,981,838 B2
(45) Date of Patent: Jan. 3, 2006

(54) METHOD AND APPARATUS FOR DETECTING THE OCCURRENCE OF SURGE IN A CENTRIFUGAL COMPRESSOR

(75) Inventors: Robert J. McKee, San Antonio, TX (US); Carl E. Edlund, Castroville, TX (US)

(73) Assignee: Southern Gas Association Gas Machinery Reserach Council, Dallas, TX (US)

( * ) Notice: Subject to any disclaimer, the term of this patent is extended or adjusted under 35 U.S.C. 154(b) by 145 days.

(21) Appl. No.: 10/083,232

(22) Filed: Feb. 26, 2002

(65) Prior Publication Data

US 2003/0161715 A1 Aug. 28, 2003

(51) Int. Cl.
*F04D 29/00* (2006.01)

(52) U.S. Cl. ..... 415/1; 415/17; 415/118; 417/38; 417/44.2; 417/63

(58) Field of Classification Search ..... 415/1, 415/17, 47, 118, 94; 417/63, 32, 38, 44.2
See application file for complete search history.

(56) References Cited

U.S. PATENT DOCUMENTS 4,464,720 A 8/1984 Agarwal
4,581,900 A 4/1986 Lowe et al.
4,594,051 A * 6/1986 Gaston ..... 415/48
4,686,834 A 8/1987 Haley et al.
5,224,836 A * 7/1993 Gunn et al. ..... 417/14
5,306,116 A 4/1994 Gunn et al.
5,611,664 A 3/1997 Haugen
5,746,062 A 5/1998 Beaverson et al.
5,894,736 A 4/1999 Beaverson et al.
5,913,248 A * 6/1999 Harada et al. ..... 73/861.47
5,971,712 A 10/1999 Kann
6,036,432 A 3/2000 Sishtla et al.
6,213,724 B1 4/2001 Haugen et al.

* cited by examiner

*Primary Examiner*—Edward K. Look
*Assistant Examiner*—Dwayne J. White
(74) *Attorney, Agent, or Firm*—Crutsinger & Booth, LLC

(57) ABSTRACT

A method and apparatus for detecting the occurrence of surge or incipient surge in a centrifugal compressor is supplied. The centrifugal compressor has an inlet passage, an inlet passage wall and an impeller. When flowing a fluid through the centrifugal compressor thereby establishing a fluid flow in the inlet passage, the fluid flow is measured in the inlet passage proximate the inlet passage wall and proximate the impeller. The measurements may include detecting a reverse in the fluid flow direction, measuring a tangential component to the fluid flow, measuring a substantial decrease in the axial fluid flow, and/or measuring the fluid temperature. Fluid flow in the compressor can then be modified or controlled to prevent surge.

48 Claims, 7 Drawing Sheets

METHOD AND APPARATUS FOR DETECTING THE OCCURRENCE OF SURGE IN A CENTRIFUGAL COMPRESSOR

TECHNICAL FIELD

The present invention relates generally to detection of surge conditions in a centrifugal compressor, and more particularly, to methods and apparatus for detecting incipient surge in a centrifugal compressor by measuring temperature and/or flow velocity proximate to the inlet impeller of the compressor and proximate the outer wall of that inlet.

BACKGROUND

Surge is an unwanted phenomenon in centrifugal compressors which occurs when the fluid flow rate through the compressor is reduced, to an unstable level. When the flow rate is reduced to a point below a required minimum flow rate, fluid resistance increases at the compressor discharge port and as the discharge pressure increases until surge occurs. During the occurrence of surge, the direction of fluid flow is reversed as the higher pressure fluid at the discharge flows backward into the compressor.

Surge is undesirable for a number of reasons. Compressor surge produces unstable fluid flow within the compressor, increased thrust loads on compressor components, produces loud noises, and increases the amount of heat generated within the compressor. Frequently, one of the consequences of surge is damage to compressor components.

One conventional way of avoiding surge is by increasing the fluid flow rate through the compressor, often by recirculating fluid back through the compressor. Although surge is avoided by increasing the flow rate through the compressor, such recirculation of flow through the compressor adversely affects the compressor efficiency and, therefore, the cost of operation.

Surge in centrifugal compressors can be understood to occur at low flow conditions below which the rotating impeller cannot impart sufficient momentum to the flow to overcome the suction to discharge head. During surge, flow through a compressor becomes unstable and momentarily reverses direction, thereby shock loading the compressor, disrupting system operations, and potentially damaging the compressor. Centrifugal compressors that operate over a range of conditions must be protected from inadvertent entry into surge.

The approach of a compressor to surge is normally monitored by external measurement of flow rate and pressure to determine the compressor's condition relative to a line of flow and head that is selected as the surge control limit. This common approach is inferential and is dependent on proper selection of the surge control line. Currently, no widely accepted reliable methods are available to establish an accurate surge margin line. Setting the surge limit at too high a flow rate limits the efficient operation of the compressor and results in wasted energy and an unnecessary loss of efficiency during low flow conditions. Setting the surge limit too low can result in the compressor reaching surge and being damaged.

SUMMARY

A method and apparatus for detecting the occurrence of surge or incipient surge in a centrifugal compressor is supplied. The centrifugal compressor has an inlet passage, an inlet passage wall and an impeller. When operating, a fluid flows through the centrifugal compressor thereby establishing a flow in the inlet passage. When the fluid flow is measured in the inlet passage proximate to the inlet passage outer wall and proximate to the impeller, the measurements will indicate a reversed flow pattern, including a tangential component in the flow, a substantial decrease in the axial flow velocity, and an increase in the fluid temperature. Fluid flow in the compressor can then be modified or controlled to prevent surge.

DETAILED DESCRIPTION OF A PREFERRED EMBODIMENT

Figure 1:
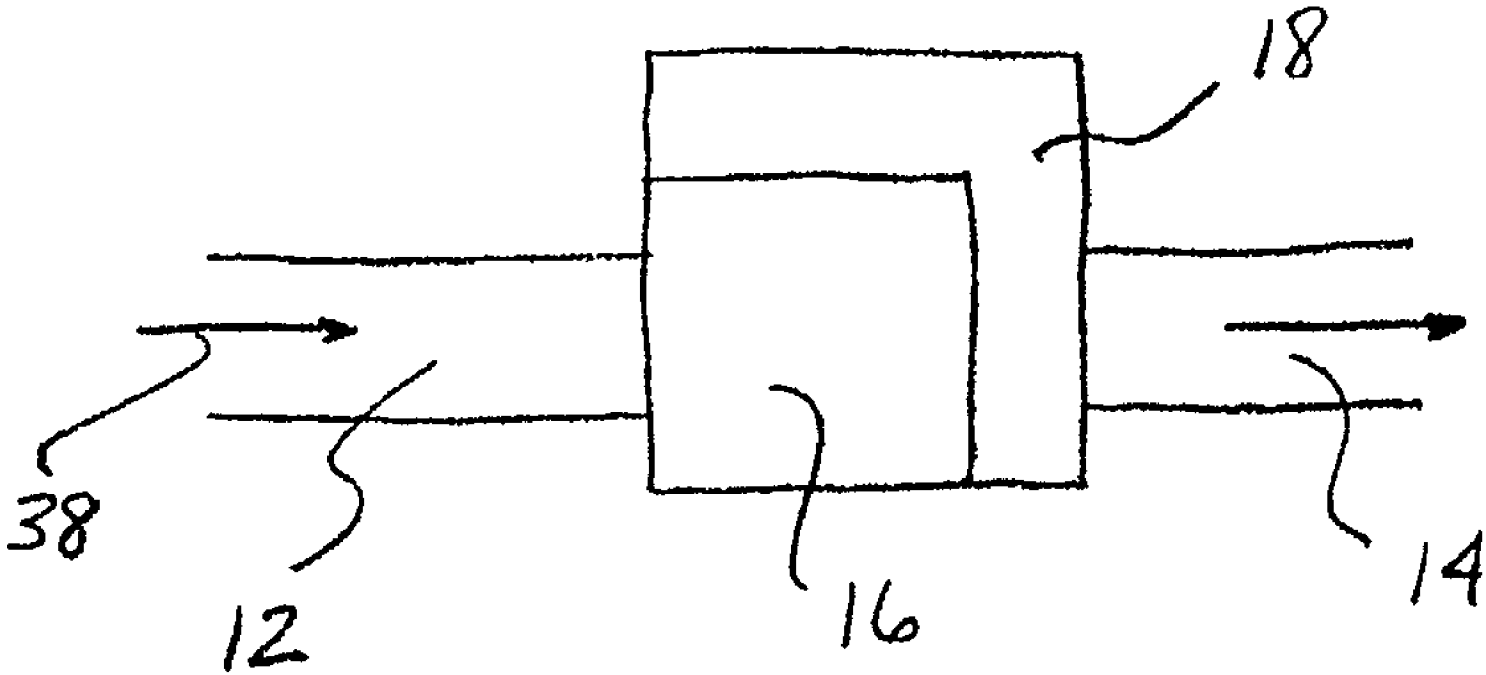
FIG. 1 is a block diagram of a fluid flow system using a centrifugal compressor.

Referring now to the drawings, wherein similar reference characters designate corresponding parts throughout the several views, FIG. 1 is a schematic diagram of a fluid flow system 10. Fluid flow system 10 includes an upstream and a downstream conduit 12 and 14 fluidly connected to a centrifugal compressor 16. Fluid flows from the upstream conduit 12, through the compressor 16 and on through the downstream conduit 14. A fluid flow control means 18 is also provided and may consist of recirculation pipes and valves, safety and bypass valves, and other control mechanisms as are known in the art. The system 10 may be a gas pipeline system, a gas process system, an air system, or any other fluid flow system known in the art.

Figure 2:
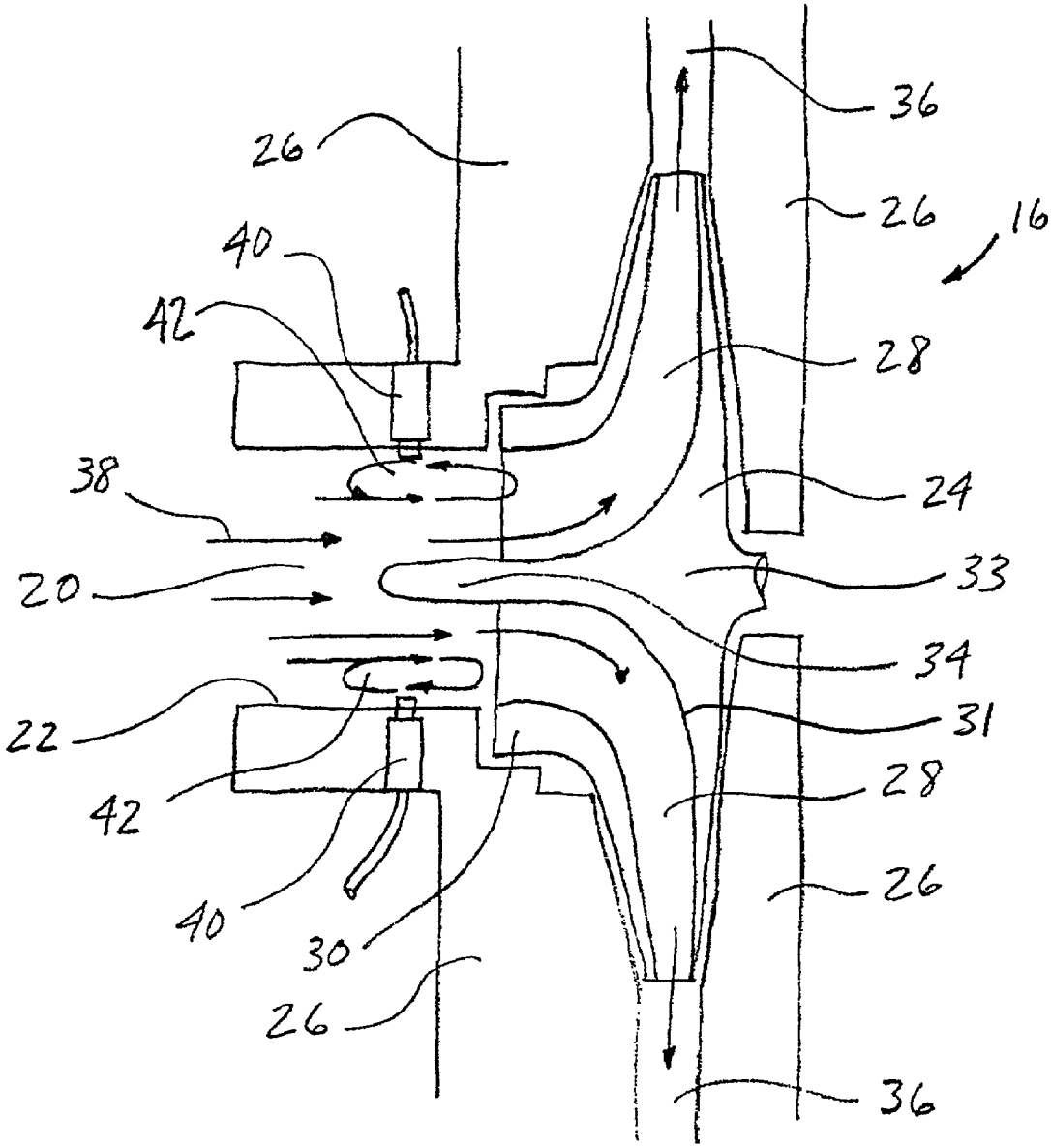
FIG. 2 is a cross-section of a detail portion of a centrifugal compressor.
Figure 3:
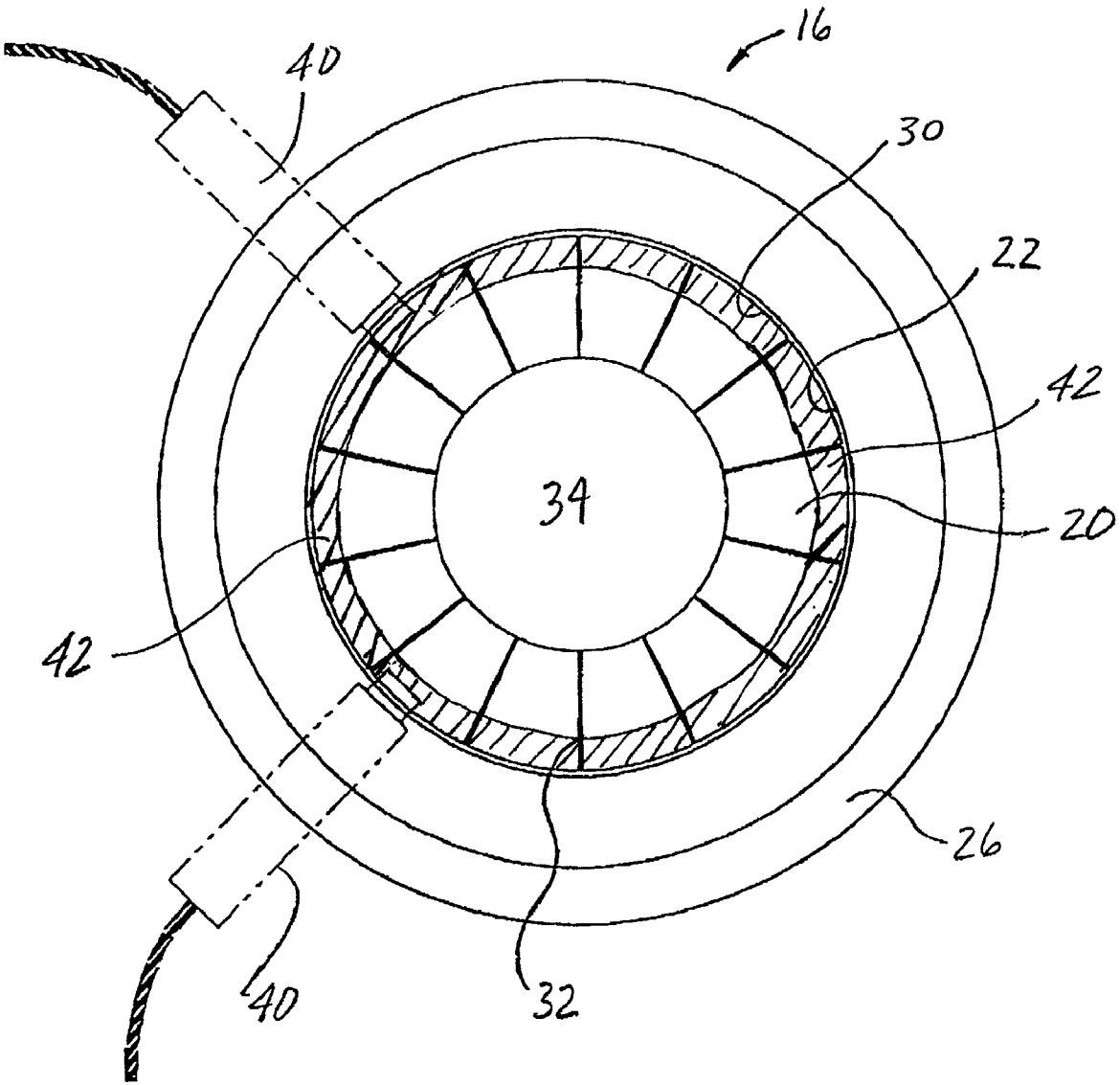
FIG. 3 is a partial elevational view of a centrifugal compressor inlet area.

FIGS. 2 and 3 are detail views of a typical centrifugal compressor 16 with an inlet passage 20, defined by an inlet passage wall 22, leading to an impeller 24 encased in a casing 26. The impeller 24 has multiple impeller passages 28 defined by the impeller shroud 30 and interior wall 31 of the impeller hub 34. The impeller 24 has blades 32 for directing fluid flow and a hub 33 with a hub center 34. In use, the centrifugal compressor 16 establishes a fluid flow through inlet passage 20 into the impeller 24 and then out through outlet 36. When the compressor is operating, a fluid flow 38 is established in the inlet passage 20. In normal operation, the flow 38 will exist, or be established, in a substantially steady state.

Sensors 40 are placed in the inlet passage 20, in operable communication with the inlet area proximate the inlet passage wall 22 and proximate the impeller 24, as shown. The sensors 40 are preferably attached to the inlet wall 22, extending through the casing 26, but other arrangements can be used. Preferably multiple sensors 40 are employed. The sensors 40 detect changes in magnitude, direction, and character of the fluid flow 38 in a recirculation zone 42 within the inlet passage 20.

Figure 4:
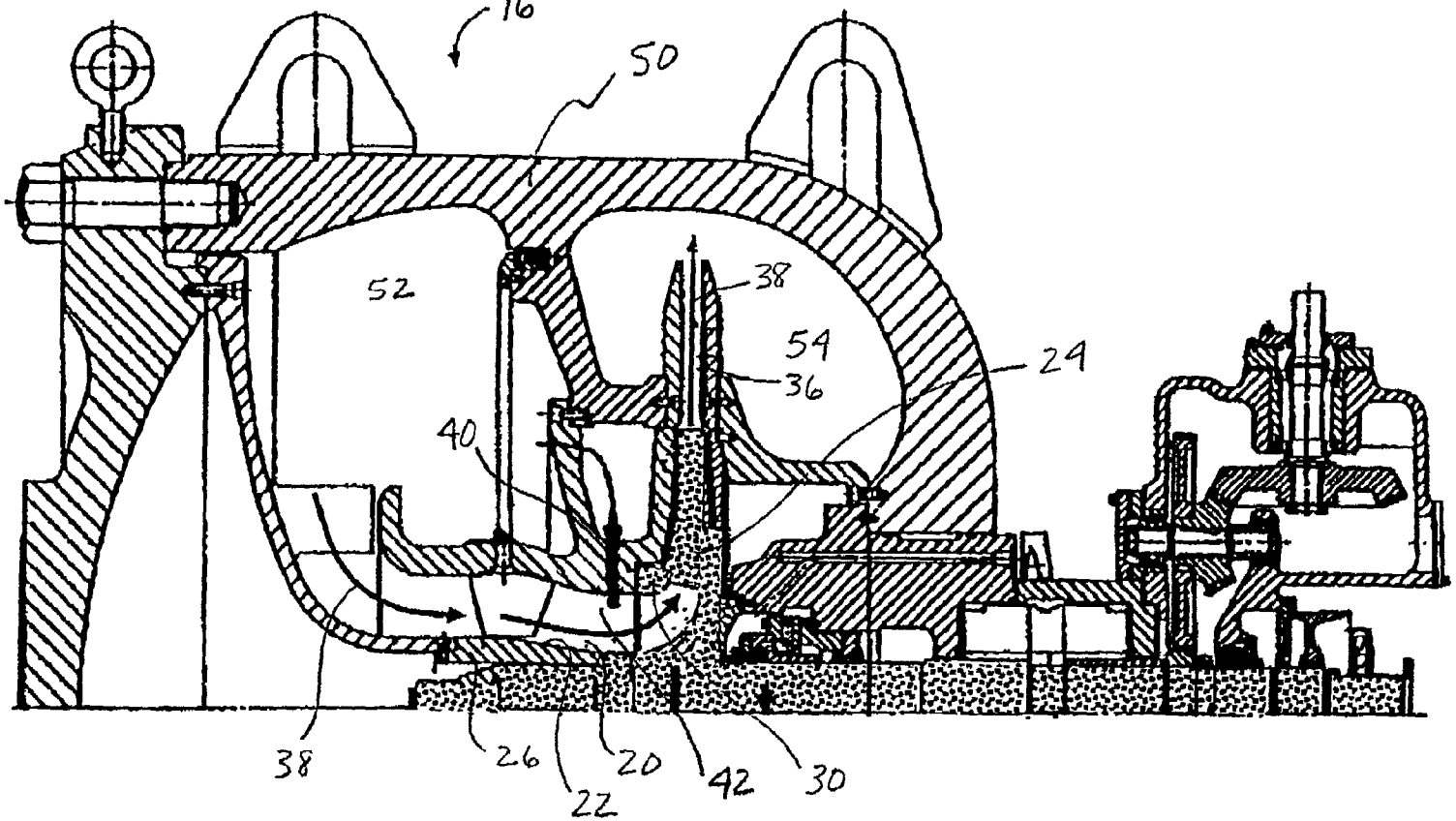
FIG. 4 is a partial cross-sectional view of a centrifugal compressor and housing.

The recirculation zone 42, as shown in FIGS. 2–4, is the area within the inlet passage where normal flow conditions will undergo substantial changes prior to the occurrence of surge. The flow pattern changes includes a substantial decrease in axial flow, an increase in tangential flow, an increase in fluid temperature, or a combination of these. The change in flow condition local to the inlet passage wall 22 and near the impeller 24 can be used to determine if the compressor 16 is near the surge condition. The sensors 40 preferably include a temperature sensor, a flow velocity sensor. The flow velocity sensor is preferably capable of detecting axial fluid flow, tangential fluid flow, increases and decreases in these flows, and/or a reversal of flow direction. Optionally, other sensors may be used to detect some or all of these flow characteristics. Any one type of sensor may indicate incipient surge, but preferably a combination of sensors is employed.

Controller 18 includes all appropriate electronics, software, hardware, etc., as known in the art, and operates to control operation of the centrifugal compressor. Flow measurements from sensors 40 can be input to the controller. Upon receiving measurements indicative of incipient surge, the controller 18 operates to manipulate the compressor and valve systems to return to a normal flow pattern. Controllers are known in the art and readily available.

The invention described herein identifies fundamental changes in the flow patterns within centrifugal compressors that directly signal the approach to surge. This invention provides a means to measure the changes in flow and temperatures internal to compressors that indicate and can measure the approach of a surge condition. It was observed during laboratory testing of a small centrifugal compressor 16 that a recirculation zone 42 develops in the flow immediately upstream of impeller 24. As a compressor approaches surge, a recirculation develops in the outer annulus of the impeller inlet area and this change in the local flow condition can be used to determine if the compressor is close to a surge condition.

Flow and relative temperature measurements made near the outer wall 22 of a centrifugal compressor's impeller inlet passage 20 indicate changes in magnitude and direction of the flow 38 that are an indication that the compressor is approaching a surge condition. In the normal operating range, the inlet flow 38 to an impeller 24 is uniform in temperature and axial velocity and may be described as steady state. As the flow 38 is reduced toward a surge condition, the flow velocity at the outer wall 22 of the impeller inlet passage 20 decreases considerably more than the mean flow through the inlet and actually reverses in direction before surge occurs, creating a recirculation zone 42. As a result of this recirculation, the temperature of the gas or other fluid in the outer inlet area increases relative to the bulk inlet gas temperature. A tangential or rotational component is also imparted to the impeller suction flow 38 near the wall 22 immediately upstream of the impeller 24. All of these changes can be used to indicate that the compressor internal conditions are near the surge condition.

FIGS. 2 and 3 show the inlet 20 of a small compressor's impeller 24 and the locations of temperature and flow velocity sensors 40. In addition to these measurements, during testing, discharge pressure and other measurements were made to determine the operating condition of the compressor. The temperature sensors used were small rapid response thermocouples. The flow sensors used measured to the fluid velocity, namely the fluid speed and direction. The inlet piping was three inches in diameter. The compressor speed was held constant for each test and the compressor flow was reduced towards surge by partially closing a valve on the discharge side of the compressor.

Figure 5:
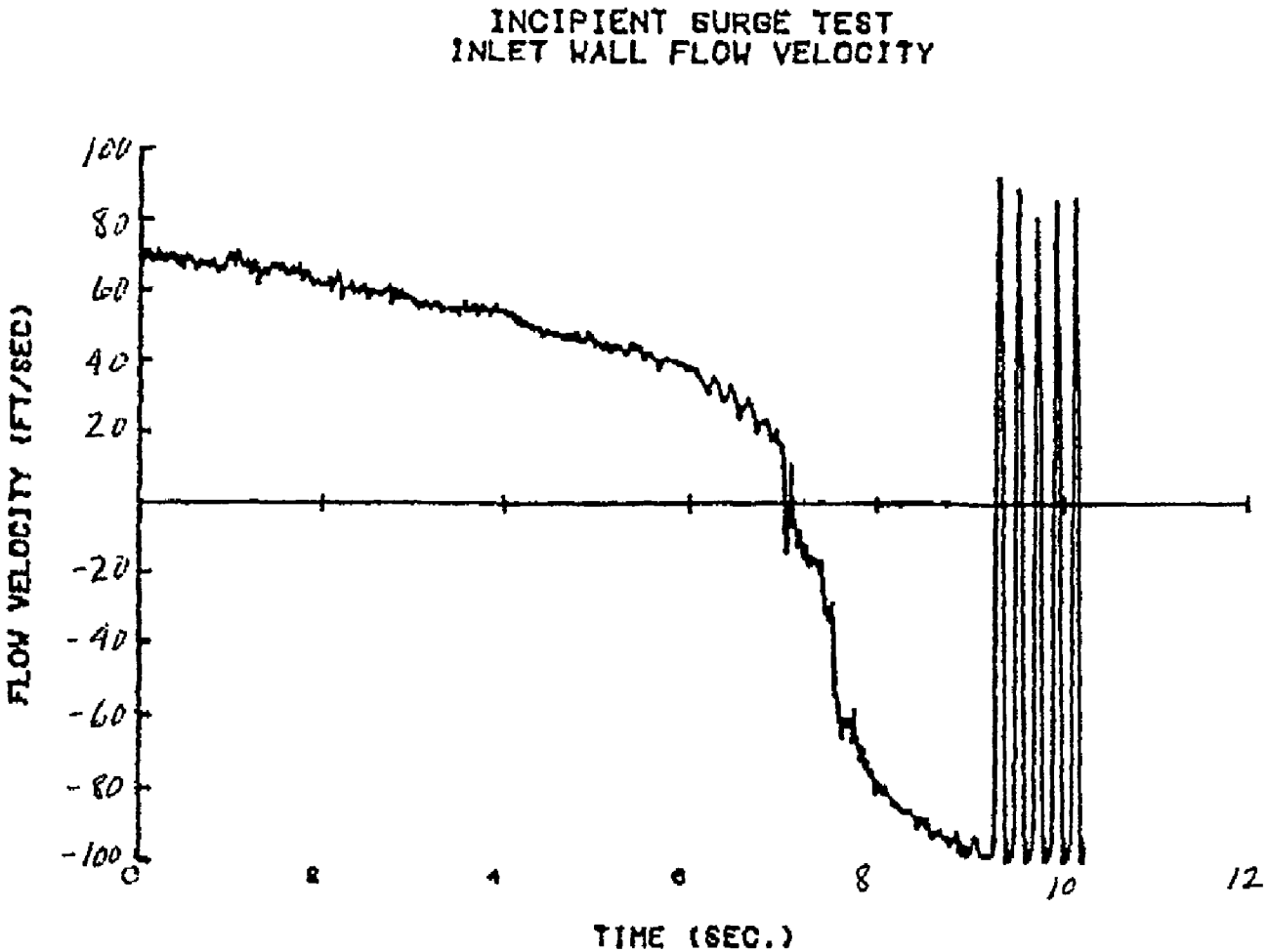
FIG. 5 is a graphical representation of an incipient surge test showing inlet wall axial flow velocity as surge is approached.

The change in inlet wall flow velocity as the compressor approaches surge is shown in FIG. 5. From a normal positive flow, the velocity decreases, becomes negative, and then oscillates between positive and negative when the compressor enters the surge condition. Note that the reverse flow velocity just before surge is the same value as the minimum extreme during the surge cycle.

Figure 6:
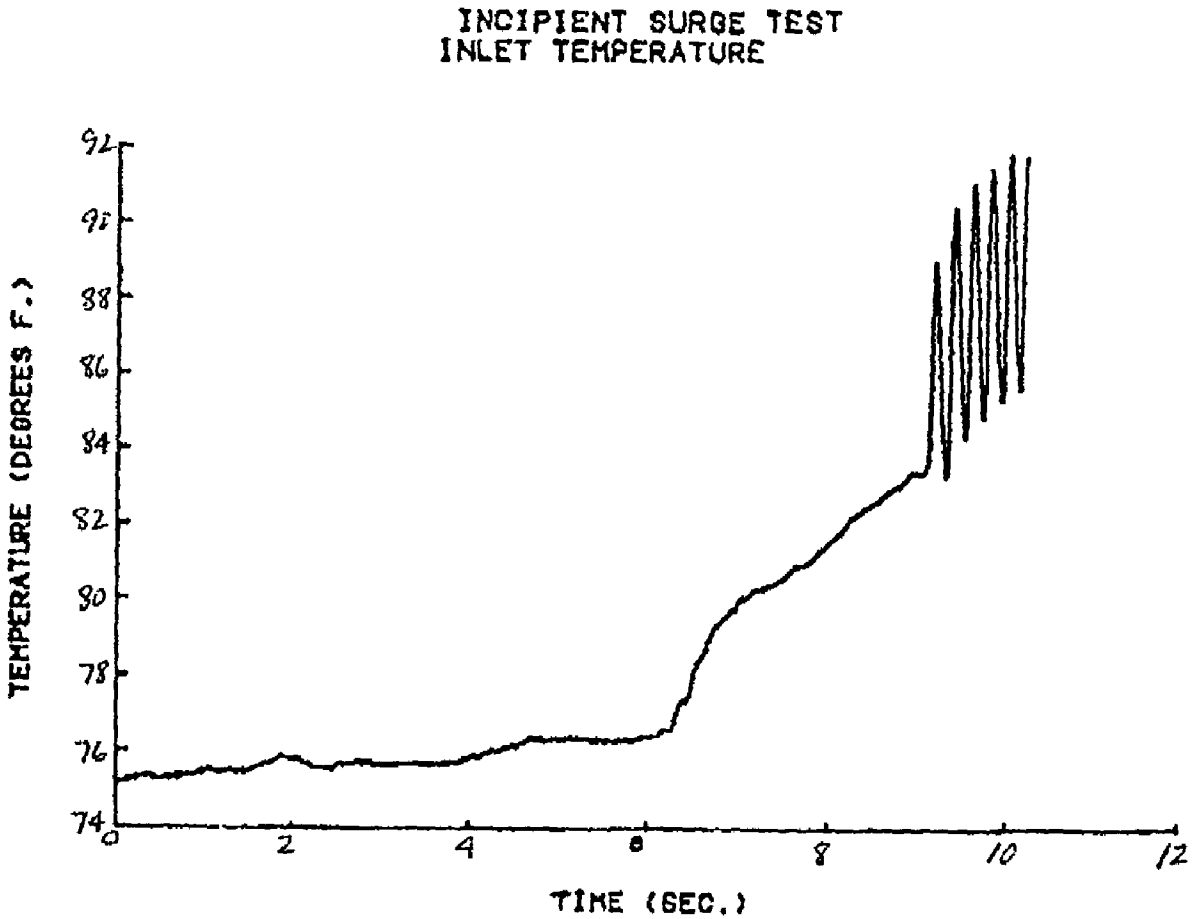
FIG. 6 is a graphical representation of an incipient surge test showing inlet temperature as surge is approached.

The near outer wall, impeller inlet gas temperature change from a constant 75° F. inlet temperature, is shown in FIG. 6. This increase in local temperature is due to the fact that gas returning to the outer wall area during the recirculation has been partially compressed in the impeller before it returns to the impeller inlet. Other inlet temperature measurements near the outer wall and the impeller tips show the same increase in local temperatures as the surge condition approached.

Figure 7:
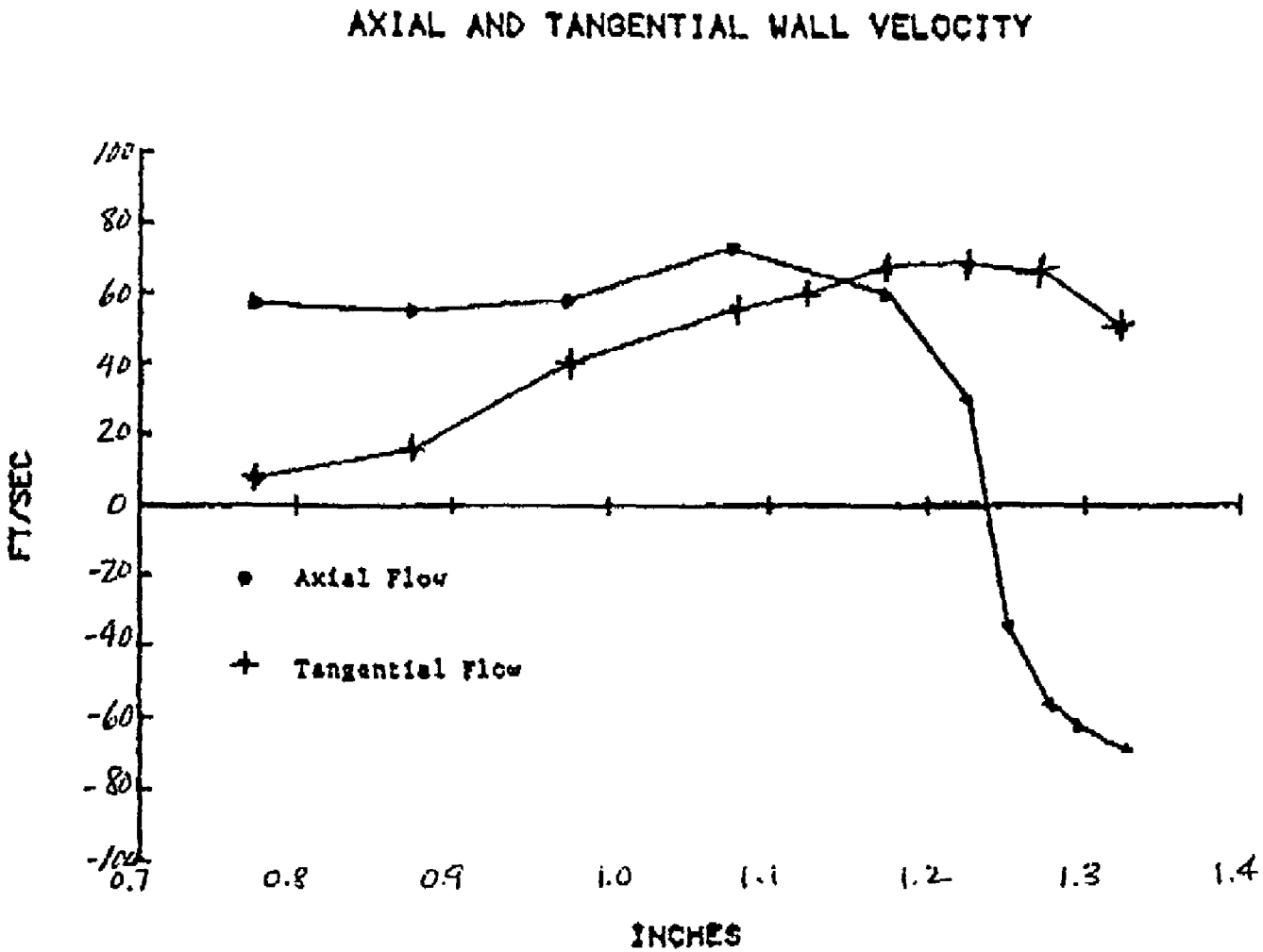
FIG. 7 is a graphical representation of an incipient surge test showing axial and tangential flow velocities at several locations.

A traverse of the inlet flow in front of the impeller was performed to identify the area of reverse flow. At normal operating conditions away from surge the axial flow velocity is quite uniform over the impeller inlet area and there is little to no tangential component in the flow. As surge is approached, the axial velocity near the inside or hub of the impeller inlet is not changed but the velocity near the outer wall decreases and reverses as shown in FIG. 7. In FIG. 7, the hub of the impeller starts at approximately 0.75 inches on the scale and the outer wall is at approximately 1.35 inches on the velocity verses radial distance plot. FIG. 7 also shows that at this near surge condition there is a tangential velocity component near the outer wall which decreases to nearly zero near the hub. This type of data was repeated and appears to be a fundamental indication that the compressor is reaching its minimum stable flow-surge limit.

This invention shows that a reverse flow and temperature rise in the outer wall area of an impeller inlet is a general attribute of centrifugal compressors as they approach the surge conditions. This invention includes the use of flow sensors and temperature indicators located close to the impeller and close to the inlet wall to detect the fundamental changes that indicate approaching surge. This invention offers an effective method of detecting the approach of surge and of controlling centrifugal compressors operating near surge.

These findings are applicable to various size and design of compressors. An exemplary compressor 16 is shown in FIG. 4 having a housing 50, a suction chamber 52, discharge chamber 54, inlet passage 20, impeller 24, casing 26 and other parts as labeled and as known in the art. Sensor 40 is shown extending through casing 26 and into the inlet passage 20 and recirculation zone 42.

Preferably a control means 18 is provided. When surge conditions are present, as indicated by the measurements of sensors 40, appropriate flow control steps may be taken to prevent surge, such as by increasing flow to the inlet passage, via a recirculation system or by other means known in the art, or otherwise moderating the compressor operation as is known in the art.

It will be apparent to those skilled in the art that various modifications and variations can be made in the surge detection method and apparatus of the present invention and in construction of this method and apparatus without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for detecting the occurrence of surge or incipient surge in a centrifugal compressor, the method comprising the steps of:

operating the centrifugal compressor having an inlet passage, an inlet passage wall and an impeller, thereby establishing a bulk fluid flow to the compressor and a local axial fluid flow in a recirculation zone in the inlet passage proximate to the inlet passage wall and proximate to the impeller; and detecting a decrease in the local axial fluid flow, wherein the decrease in the local fluid flow is greater than any concurrent decrease in the bulk fluid flow to the compressor.

2. A method as in claim 1 wherein the step of detecting the local fluid flow includes detecting a reversal in the local fluid flow direction in the recirculation zone.

3. A method as in claim 1 wherein the step of detecting the local fluid flow includes detecting a tangential component to the local fluid flow in the recirculation zone.

4. A method as in claim 1 wherein the step of detecting the fluid flow includes detecting a substantial decrease in the local axial fluid flow in the recirculation zone.

5. A method as in claim 1 wherein the step of detecting the fluid flow includes detecting changes in the local fluid flow temperature in the recirculation zone.

6. A method as in claim 2 wherein the step of detecting the fluid flow includes detecting the local fluid flow temperature in the recirculation zone.

7. Method as in claim 1 further comprising the step of controlling the bulk fluid flow through the compressor.

8. A method as in claim 7 wherein the step of controlling the fluid flow includes increasing the bulk fluid flow to the inlet passage.

9. A method as in claim 2 further comprising the step of controlling the bulk fluid flow through the compressor.

10. A method as in claim 3 further comprising the step of controlling the bulk fluid flow through the compressor.

11. A method as in claim 5 further comprising the step of controlling the bulk fluid flow through the compressor.

12. A method as in claim 4 further comprising the step of controlling the bulk fluid flow through the compressor.

13. A method as in claim 1 wherein the step of detecting includes measuring the fluid flow using at least one fluid velocity sensor.

14. A method as in claim 13 wherein the at least one fluid velocity sensor is attached to the inlet passage wall.

15. A method of detecting surge or incipient surge in a centrifugal compressor, the compressor having an impeller and an inlet passage upstream of the impeller, the method comprising the steps of:

operating the compressor, thereby establishing a substantially steady state fluid flow through the inlet passage and impeller; and measuring the local fluid flow velocity in a recirculation zone in the inlet passage proximate to the inlet passage wall and proximate to the impeller, wherein the step of measuring the fluid flow includes measuring a tangential component to the fluid flow in the recirculation zone.

16. A method as in claim 15 wherein the step of measuring the fluid flow includes detecting a reversal in the fluid flow direction in the recirculation zone.

17. A method as in claim 15 wherein the step of measuring the fluid flow includes measuring a substantial decrease in the axial fluid flow in the recirculation zone.

18. A method as in claim 15 wherein the step of measuring the fluid flow includes measuring changes in the fluid flow temperature.

19. A method as in claim 16 wherein the step of measuring the fluid flow includes measuring changes in the fluid flow temperature.

20. A method as in claim 15 further comprising the step of controlling the flow through the compressor.

21. A method as in claim 20 wherein the step of controlling the fluid flow includes increasing the fluid flow to the inlet passage.

22. A method as in claim 16 further comprising the step of controlling the flow through the compressor.

23. A method as in claim 19 further comprising the step of controlling the flow through the compressor.

24. A method as in claim 20 further comprising the step of controlling the flow through the compressor.

25. A method as in claim 15 wherein the step of measuring includes measuring the fluid flow using at least one fluid velocity sensor.

26. A method as in claim 25, the inlet passage having an inlet passage wall and wherein the at least one fluid velocity sensor is attached to the inlet passage wall.

27. A method for detecting the occurrence of surge or incipient surge in a fluid flow system, the fluid flow system having a centrifugal compressor in fluid communication with an upstream fluid conduit and a downstream fluid conduit, the centrifugal compressor having an inlet passage and an impeller, the method comprising the steps of:

operating the compressor, thereby establishing substantially steady state fluid flow through the inlet passage and impeller; and measuring the fluid flow in a recirculation zone in the inlet passage proximate to the inlet passage wall and proximate to the impeller, wherein the step of measuring the fluid flow includes measuring a tangential component to the fluid flow in the recirculation zone.

28. A method as in claim 27 wherein the step of measuring the fluid flow includes measuring a reverse in the fluid flow direction in the recirculation zone.

29. A method as in claim 27 wherein the step of measuring the fluid flow includes measuring a substantial decrease in the axial fluid flow in the recirculation zone.

30. A method as in claim 27 wherein the step of measuring the fluid flow includes measuring changes in the fluid flow temperature.

31. A method as in claim 27 further comprising the step of controlling the flow through the compressor.

32. A method as in claim 31 wherein the step of controlling the fluid flow includes increasing the fluid flow to the inlet passage.

33. A method as in claim 28 further comprising the step of controlling the flow through the compressor.

34. A method as in claim 29 further comprising the step of controlling the flow through the compressor.

35. A method as in claim 30 further comprising the step of controlling the flow through the compressor.

36. A method as in claim 27 wherein the step of measuring includes measuring the fluid flow using at least one fluid velocity sensor.

37. A method as in claim 36, the inlet passage having an inlet passage wall and wherein the at least one fluid velocity sensor is attached to the inlet passage wall.

38. A method as in claim 27 wherein the fluid flow system comprises a gas pipeline.

39. A method as in claim 28 wherein the step of measuring includes measuring changes in the fluid temperature.

40. An apparatus for detecting the occurrence of surge or incipient surge in a centrifugal compressor, the apparatus comprising:

a centrifugal compressor having an inlet passage, with an inlet passage wall, and an impeller, a zone defined proximate the wall of the inlet passage and proximate the impeller, immediately upstream of the impeller; and at least one sensor operable for measuring fluid flow in said zone, wherein the sensor is capable of measuring a tangential component of fluid flow in the zone.

41. An apparatus as in claim 40 wherein at least one sensor is a fluid velocity sensor measuring fluid flow speed and direction.

42. An apparatus as in claim 40 wherein at least one sensor is capable of measuring a reversal in fluid flow direction in the zone.

43. An apparatus as in claim 40 further comprising a temperature sensor.

44. An apparatus as in claim 41 further comprising a temperature sensor.

45. An apparatus as in claim 40 wherein the at least one sensor is attached to the inlet passage wall.

46. An apparatus as in claim 40 further comprising a means of controlling the fluid flow through the centrifugal compressor.

47. An apparatus as in claim 41 further comprising a means of controlling the fluid flow through the centrifugal compressor.

48. An apparatus as in claim 42 further comprising a means of controlling the fluid flow through the centrifugal compressor.

* * * * *